United States Patent [19]

Tornoe

[11] 4,359,666

[45] Nov. 16, 1982

[54] CYLINDRICAL CATHODE WITH SEGMENTED ELECTRON EMISSIVE SURFACE AND METHOD OF MANUFACTURE

[75] Inventor: Robert N. Tornoe, Fremont, Calif.

[73] Assignee: Varian Associates, Inc., Palo Alto, Calif.

[21] Appl. No.: 170,350

[22] Filed: Jul. 21, 1980

[51] Int. Cl.[3] ..... H01J 1/46; H01J 21/10

[52] U.S. Cl. ..... 313/302; 29/25.17; 313/304; 313/338; 313/348

[58] Field of Search ..... 313/302, 303, 304, 338, 313/348; 29/25.17, 25.18

[56] References Cited

U.S. PATENT DOCUMENTS

| | | | |
|---|---|---|---|
| 3,186,884 | 6/1965 | Haan et al. | 313/348 X |
| 3,585,438 | 6/1971 | Bell | 313/338 |
| 3,814,972 | 6/1974 | Sain | 313/302 |
| 3,818,260 | 6/1974 | Elfe, Jr. et al. | 313/338 |
| 3,967,150 | 6/1976 | Lien et al. | 313/304 |
| 4,058,432 | 11/1977 | Woldan et al. | 313/348 |
| 4,223,243 | 9/1980 | Oliver et al. | 313/302 |
| 4,254,357 | 3/1981 | Haas et al. | 313/304 |
| 4,302,702 | 11/1981 | Montgaillard et al. | 313/348 |

*Primary Examiner*—Saxfield Chatmon, Jr.
*Attorney, Agent, or Firm*—Stanley Z. Cole; Keiichi Nishimura

[57] ABSTRACT

A new method of fabricating a cylindrical segmented cathode by bending a photoetched bar-band to form a cylindrically-shaped cage and slipping it over a cylindrical electron emissive surface which will tightly fit inside the cage when the cathode is raised to its normal temperature. The bars of the band provide nonemissive segments of the cathode surface.

13 Claims, 5 Drawing Figures

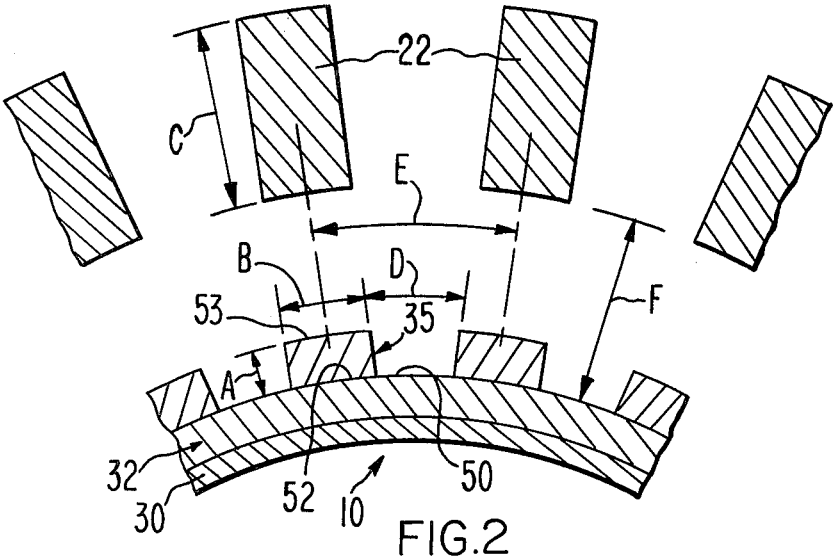
FIG.2
FIG.3a
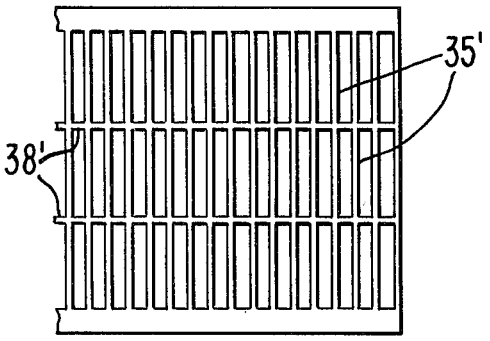
FIG.3c
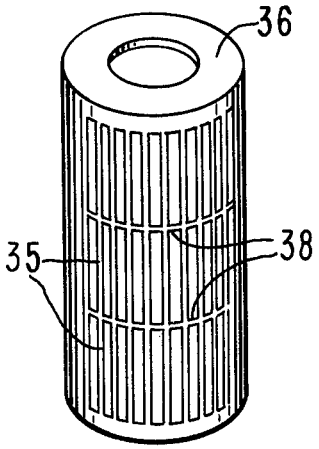
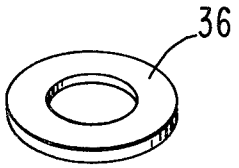
FIG.3b

CYLINDRICAL CATHODE WITH SEGMENTED ELECTRON EMISSIVE SURFACE AND METHOD OF MANUFACTURE

DESCRIPTION

BACKGROUND OF THE INVENTION

The present invention relates to a method of fabricating a segmented cathode with striped electron emitting and nonemitting areas.

One way in which to increase amplification in a triode electron tube is to increase the number or density of grid wires. This method, however, has the consequence of undesirable increase in grid current. Thus, tetrodes and pentodes have been developed in order to increase the amplification while preventing the grid current from increasing, but such multi-electrode tubes are necessarily more complex in structure and hence more expensive to produce.

U.S. Pat. No. 3,814,972 issued June 4, 1974 to W. H. Sain and assigned to the assignee of the present invention illustrates an improved triode electron tube of relatively simple construction having a cylindrical cathode with its outer surface made of a plurality of alternatively located electron emitting and nonemitting areas which are electrically connected and remain equipotential with each other. Disposed coaxially around this cathode is a control grid composed of a cylindrical array of bar-like members with cross sectional dimensions and spacing within designated ranges and radially aligned with the nonemitting areas of the cathode so as to prevent the increase in grid current.

The conventional method of fabricating a cathode of this type is firstly to prepare a metal cylinder with shallow longitudinal grooves cut into the outer surface by means of hobbing or sawing, and equally spaced around the periphery, secondly to coat the entire cylinder with an electron emissive substance and finally to clean it so that the coating will stay in the grooves only. This method of "covering everything and wiping off the excess" may be adequate if the emissive coating substance is to completely fill the grooves so that the emissive and nonemissive surfaces in the final product are flush with each other. It is far from satisfactory, however, where the emissive surface must be recessed with respect to the adjacent nonemissive surfaces so that better focusing of the electron beam will be provided with the step acting as a lens to deflect electrons inwardly. Inadequacy of this method is more readily understandable where the height of the step must be accurately controlled.

SUMMARY OF THE INVENTION

An object of the invention is to provide a method of fabricating a segmented cylindrical cathode.

A further object is to provide an inexpensive and accurate method of fabricating a cylindrical segmented cathode comprising a plurality of alternately located electron emitting and non-emitting areas.

The above objectives are achieved by attaching directly onto an electron emitting surface a mask made of a nonemitting substance having a desired pattern, or more specifically by bending a thin metallic sheet with a bar-band pattern to form a cylindrical shell of uniform thickness, fastening a solid cap on one end thereof to form a cage-like structure, and slipping this structure over a cylindrical electron emissive surface having a specified diameter. Fabrication of such a mask with a precisely measured bar-band pattern has been made practicable by the recent progress in the photoetching technology.

BRIEF DESCRIPTION OF THE DRAWINGS

FIG. 2 is an enlarged fragmentary sectional view taken along the line 2—2 of FIG. 1; and FIG. 3 (*a–c*) shows in perspective the method of assembling components to make a cathode according to the present invention.

DETAILED DESCRIPTION OF THE INVENTION

Figure 1:
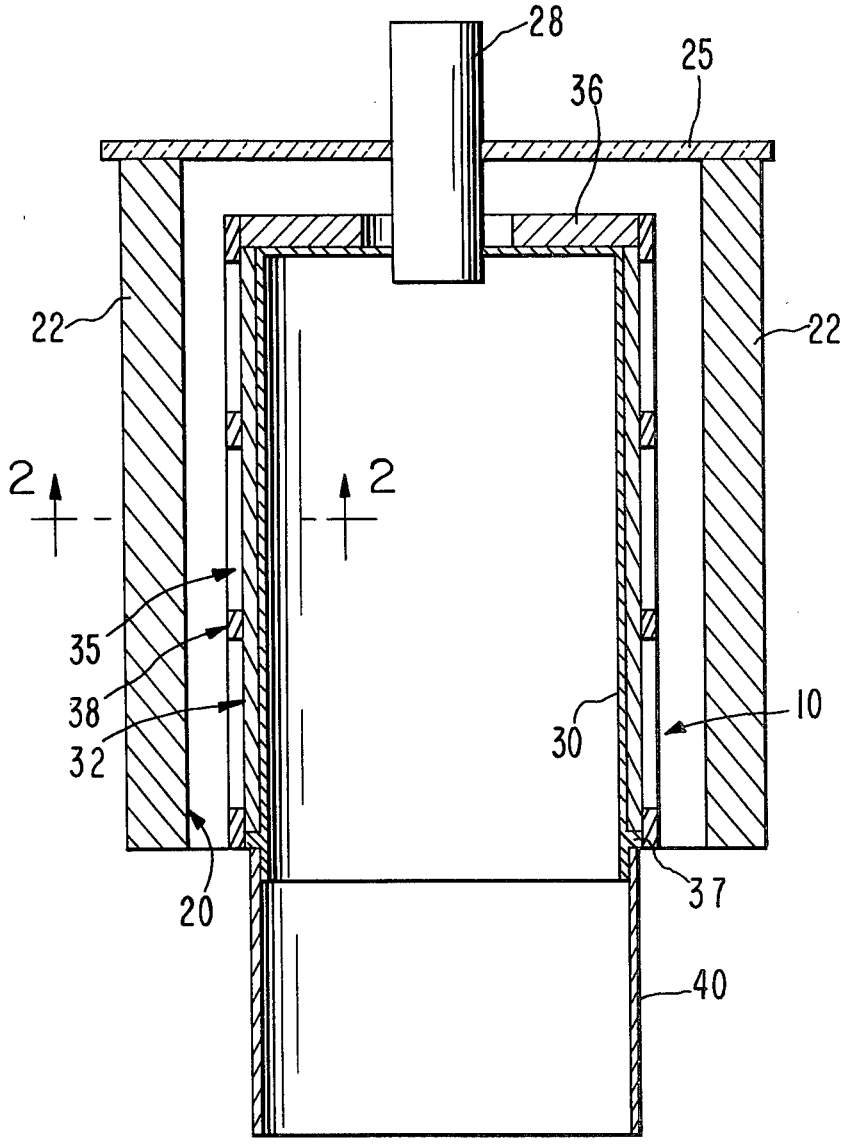
FIG. 1 is a cross sectional view of a portion of a triode electron tube embodying a cathode fabricated by the method of the present invention.

FIG. 1 shows in a cross sectional format a portion of a triode electron tube including a cathode assembly 10 embodying the present invention and a grid assembly 20 attached thereto. Grid assembly 20 is essentially a cylindrical cage formed by an array of bar-like grid members 22 of uniform cross section which are uniformly spaced and disposed longitudinally to the axis 27 of the cylinder. These grid members 22 are affixed at the top to a circular grid cap 25.

Cathode assembly 10 has an inner structure 30 which encloses a heater element (not shown) and has a cylindrical external surface covered with an electron emissive layer 32 of uniform thickness made of a thermoionic electron emitting material such as a barium-strontium mixture. In contact externally with the emissive layer 32 are masking bars 35 of uniform structure when these elements are at the normal temperature of operation. The cylindrical inner structure 30 is maintained coaxially along the axis 27 with the grid assembly 20 by means of alignment pin 28. Masking bars 35 are uniformly spaced and disposed longitudinally parallel to the axis 27 so that they also form a cylindrical cage which is coaxial to the cage formed by grid members 22. A washer 36 is affixed both to the top of the cage formed by masking bars 35 and to the top of the inner structure 30. The bottom part of inner cathode structure 30 is affixed to a base structure 40. The inner cathode structure 30 also has a "lip" 37 at the bottom to keep the cage round during its life. The entire cathode-grid combination shown in FIG. 1 is mounted coaxially inside an anode (not shown) with a cylindrical inner surface to form a triode.

A typical cross section of the cathode-grid combination at the normal temperature of operation is illustrated in FIG. 2. Same numbers therein illustrate the corresponding parts shown in FIG. 1. The cathode is now seen to be of the segmented type comprising a plurality of alternately located electron emitting areas 50 and nonemitting areas 52. Nonemitting areas 52 are made nonemitting by means of masking bars 35 covering the external surface of the emissive layer 32. Because of the finite thickness of these masking bars 35, the electron emitting areas 50 are necessarily recessed with respect to the external nonemitting surface 53 of the masking bar 35, forming a step 55 at the transition between the two areas. The step 55 is generally made sharp for better focusing of the electrons emitted from the emitting area 50 because the sharp step acts as a lens to deflect electrons inwardly toward the center of the beam. cross section and the longer axis is radially aligned with the nonemitting areas 52 so as to position the Grid members 22 are substantially elongated in cross section and the longer axis is redially aligned with the nonemitting areas 52 so as to position the grid members 22 in the "shadows" of the masking bars 35.

FIG. 2 also shows several dimensions critical to the designing of the cathode. Dimension A is the thickness of masking bar 35, or the distance between top surface 53 of the masking bar 35 and the electron emissive surface measured radially with respect to axis 27. Dimension B is the width of grid members 22 which is substantially equal to that of masking bars 35. Dimension C is the depth or the longer cross sectional dimension of grid members 22. Dimension D is separation, or distance between the edges, of adjacent masking bars 35. Dimension E is the distance between the center lines of adjacent masking bars 35. Dimension F is the distance between the grid member 22 and the emitting surface 50. These dimensions are so adjusted as to provide a highly convergent beam from each emitting area 50, resulting in a low grid current as compared to the plate current at relatively high positive grid voltages. For tubes of typical sizes, a desired focusing effect is obtained when the dimension A is less than 0.004 inch even though dimension C is increased relative to dimensions B and E in order to reduce the grid current. The grid members 22 may be made slightly narrower than the masking bar nonemitting areas to the distance between the center lines on adjacent nonemitting areas, i.e., the ratio D/E, is within the range from 0.575 to 0.735. Since the number of bar-bands 35 is generally large and hence the angular separation between adjacent bands is small, and since dimension F is generally much smaller than the radius of the cylindrical cage made of masking bars 35, it is to be understood that azimuthal dimensions B, C and E defined above are not sensitively dependent upon the radial positions at which they are measured.

FIG. 3 illustrates how a cathode is manufactured according to the method of the present invention. FIG. 3(*a*) shows a photoetched bar-band which is an apertured rectangular sheet of thermionic electron nonemitting material such as Inconel having uniform thickness A. Described on this sheet by photoetching technique is a pattern made of parallel bars 35' of uniform width B and the uniform spacing D. One or more cross bars 38' of comparable width may be described perpendicular thereto as shown in FIG. 3(*a*). The total number of the bars naturally depends on the design of the tube.

The photoetched bar-band of FIG. 3(*a*) is wrapped around a mandrel to be bent into the form of a cylindrical shell with the parallel bars 35' longitudinally aligned to become masking bars 35 of FIG. 1 and cross bars 38' become annular bars 38 of FIG. 1. The bar-band is made to maintain the cylindrical shape by resistive welding or any comparable method. A circular washer shown in FIG. 3(*b*) is also affixed to the top of this apertured cylindrical shell to form a cage-like structure as shown in FIG. 3(*c*). Washer 36 has at its center a hole which is sufficiently large not only to admit adjustment pin 28 but also to control the magnitude of electrical capacity of the structure within a desired limit.

The inner structure 30 of cathode is prepared by spraying a cylindrical nickel can with an electron emitting substance and by machining the external surface of the layer into a smooth cylindrical shape of predetermined diameter. The external surface of the emissive layer 32 must be so dimensioned that the cage-like structure formed by the masking bars 35 and the washer 36 can smoothly slip over the inner structure 30 but that there will be a tight contact between the emissive layer 32 and the masking bars 35 after the cathode is heated to its operating temperature. This means that there must be a small gap at room temperature between the outer surface of emissive layer 32 and masking bars 35 of FIGS. 1 and 2. The size of the gap naturally depends on the materials used as well as the operating temperature of the cathode. After said cage-like structure is slidingly slipped over the inner structure, the washer 36 and the top of the inner structure 30 are welded together.

Although the present invention has been illustrated in terms of a single method for a particular tube structure, this should not be construed as limitation upon the scope of the invention. For example, the word "cylindrical" used throughout this application must be interpreted according to its broadest definition, or as a surface traced by any straight line moving parallel to a fixed straight line and intersecting a fixed curve. The bar-band illustrated in FIG. 3(*a*) need not be photoetched. It may be prepared by laser cutting, chemical milling or any other method capable of producing a pattern of apertures with a sufficiently high level of tolerance. Instead of Inconel, any suitable material such as hasalloy or nickel may be used for the bar band. The true scope of the invention is indicated only by the following claims.

I claim:

1. A method of fabricating a cylindrical cathode with a segmented external surface with electron emitting and nonemitting areas, said method comprising the steps of:

fabricating an inner structure having a cylindrically-shaped thermionic electron emitting surface and an apertured cylindrical shell which can slideably contain said electron emitting surface, and sliding said shell over said electron emitting surface.

2. The method of claim 1 wherein said cylindrical shell describes a pattern comprising a band of bars.

3. The method of claim 2 wherein said pattern is created by photoetching technique.

4. The method of claim 2 wherein said bars are uniform in width, uniformly spaced and parallel to the axis of said cylindrical shell.

5. The method of claim 4 wherein the ratio of the separation between adjacent pair of said bars to the distance between the center lines of adjacent pair of said bars is within the range from 0.575 to 0.735.

6. The method of claim 1 further comprising the step of affixing a washer at one of the ends of said cylindrical shell.

7. The method of claim 6 further comprising the step of welding said washer to said inner structure.

8. The method of claim 1 wherein said shell is less than 0.004 inch in thickness.

9. The method of claim 1 wherein said shell is made of Inconel.

10. The method of claim 1 wherein said shell is made of nickel.

11. The method of claim 2 wherein said cylindrical shell and said electron emitting surface are so dimensioned that said bars come in contact with said electron emitting surface when said cathode is heated under the condition of normal operation.

12. A cylindrical segmented cathode comprising a support member having a circular outer surface, a coating of electron emissive material entirely around said outer surface, an apertured slideably fitted cylindrical shell of nonemissive material, and said shell being positioned around and electricaly connected to said emissive material.

13. The cathode of claim 12 wherein the outer dimension of said emissive coating and the inner dimension of said shell are such that said shell may be easily slipped over said emissive coating at normal room temperature and the outer surface of said emissive coating will tightly contact said shell when the cathode is raised to operating temperature.

* * * * *